US008314370B2

(12) United States Patent
Tominaga et al.

(10) Patent No.: US 8,314,370 B2
(45) Date of Patent: Nov. 20, 2012

(54) COOKING DEVICE

(75) Inventors: Hiroshi Tominaga, Hyogo (JP); Keiko Isoda, Hyogo (JP); Masamichi Komada, Hyogo (JP); Fumitaka Ogasawara, Hyogo (JP); Kuniaki Sakakibara, Hyogo (JP)

(73) Assignee: Panasonic Corporation, Osaka (JP)

( * ) Notice: Subject to any disclaimer, the term of this patent is extended or adjusted under 35 U.S.C. 154(b) by 471 days.

(21) Appl. No.: 12/666,086

(22) PCT Filed: Jun. 23, 2008

(86) PCT No.: PCT/JP2008/001620

§ 371 (c)(1),
(2), (4) Date: Dec. 22, 2009

(87) PCT Pub. No.: WO2009/001543

PCT Pub. Date: Dec. 31, 2008

(65) Prior Publication Data

US 2010/0176115 A1 Jul. 15, 2010

(30) Foreign Application Priority Data

Jun. 22, 2007 (JP) ..... 2007-164617

(51) Int. Cl.
*H05B 3/68* (2006.01)

(52) U.S. Cl. ..... 219/445.1

(58) Field of Classification Search ..... 219/445.1
See application file for complete search history.

(56) References Cited

U.S. PATENT DOCUMENTS 4,453,068 A * 6/1984 Tucker et al. ..... 219/625
4,511,781 A * 4/1985 Tucker et al. ..... 219/626

FOREIGN PATENT DOCUMENTS

| | | |
|---|---|---|
| JP | 4-222319 | 8/1992 |
| JP | 10-246444 | 9/1998 |
| JP | 2002-5444 | 1/2002 |
| JP | 2002-343546 | 11/2002 |
| JP | 2003-185152 | 7/2003 |
| JP | 2005-268208 | 9/2005 |
| JP | 2005-308266 | 11/2005 |

OTHER PUBLICATIONS

International Search Report issued Sep. 9, 2008 in International (PCT) Application No. PCT/JP2008/001620.

An English translation of the International Preliminary Report on Patentability and Written Opinion of the International Searching Authority issued Jan. 12, 2010 in International (PCT) Application No. PCT/JP2008/001620.

* cited by examiner

*Primary Examiner* — Alexander Ghyka
(74) *Attorney, Agent, or Firm* — Wenderoth, Lind & Ponack, LLP.

(57) ABSTRACT

A cooking device includes, on its upper surface, an operation unit and a display unit. The operation unit includes a mode selection key for selecting one of a plurality of control modes, output increasing/decreasing keys for increasing and decreasing a set output and a set temperature, and time increasing/decreasing keys for increasing and decreasing heating. The mode selection key is separated from the time increasing/decreasing keys on the opposite side of the output increasing/decreasing keys. The display unit includes a numerical value display section for displaying a numerical value of a set value in the selected control mode, an output display section for displaying the set value for heating output, and a mode display section for displaying a cooking mode selected by using the mode selection key. The numerical value display section is separated from the mode display section on the opposite side of the output display section.

18 Claims, 2 Drawing Sheets

COOKING DEVICE

TECHNICAL FIELD

The present invention relates to a cooking device including an operation unit provided on an upper surface of the cooking device.

BACKGROUND ART

A conventional cooking device includes an output display section located near an output changing section for changing a setting value for heating output; one or more time increasing keys having only a function of increasing a temperature adjustment time; a numerical value display section for time display located near the time increasing key; a cooking mode selection key located near the numerical value display section for setting a cooking mode such as a temperature adjustment mode for automatically adjusting an oil temperature at the time of fried-food cooking; and a mode display section located near the numerical value display section for indicating the selected cooking mode, and the mode display section displays a changed result in common with the numerical value display section for time display when changing at least one set value other than the time display, such as temperature display for displaying a set temperature in the temperature adjustment mode, by using an output increasing key and an output decreasing key (see e.g., JP-A-2003-185152).

However, the conventional configuration is not easy to use because the time increasing key can only be adjusted to increase time. To solve such a problem, it is considered to add a key having a function of decreasing time. For example, it is considered to provide a set of a time increasing key for increasing the set time and a time decreasing key for decreasing the set time (hereinafter also referred to as "a time increasing/decreasing key").

However, if the time increasing/decreasing key is provided, there is a high possibility of mistakenly recognizing that time can be set using the time increasing/decreasing key since the mode display section is in the vicinity of the numerical value display section, when the cooking mode in which time cannot be set by using a timer, such as the temperature adjustment mode, is selected.

It is also considered to change the set temperature by using the time increasing/decreasing key instead of having the time increasing key dedicated to changing time. In this case, however, a user can not know that either a function of increasing/decreasing of time or a function of changing of output is activated, and the user may become confused.

As described above, the conventional cooking device is not easy to use in terms of key operation.

In view of solving the problems of the related art, it is an object of the present invention to provide a cooking device that is easy to use in terms of key operation. For example, a total number of keys is reduced to simplify the key configuration, and furthermore, the timer increasing/decreasing key can be easily recognized as being dedicated to a timer function.

SUMMARY OF THE INVENTION

In order to solve the above-mentioned problems, a cooking device according to the present invention includes: a top plate provided on an upper surface of the cooking device; a heating unit operable to heat an object to be heated provided on the top plate; a control unit operable to control a heating output of the heating unit for cooking according to a control mode selected from a plurality of control modes, the plurality of control modes including a heating mode for controlling the heating unit to heat the object to be heated based on a predetermined set value for heating output; an operation unit and a display unit provided on an upper surface of the cooking device; and a timer operable to count time for heating for a predetermined set time in one of the plurality of control modes. The operation unit includes a mode selection key for selecting one of the plurality of control modes, an output increasing/decreasing key for increasing and decreasing a set output and a set temperature, and a time increasing/decreasing key for increasing or decreasing time for heating according to the timer. The display unit includes a numerical value display section for displaying a numerical value of a set value in the selected control mode, an output display section for displaying the set value for heating output, and a mode display section for displaying a cooking mode selected by using the mode selection key. The numerical value display section is located near the time increasing/decreasing key, the output display section is located near the output increasing/decreasing key, the mode selection key is located on the opposite side of the output increasing/decreasing key from the time increasing/decreasing key, and the numerical value display section is located on an opposite side of the output display section from the mode display section. Thus, the mode selection key and the time increasing/decreasing key are separated at the portion of the output increasing/decreasing key, and the numerical value display section and the mode display section are separated at the portion of the output display section. A distance between the mode display section and the output increasing/decreasing key thus becomes shorter than a distance between the mode display section and the time increasing/decreasing key. Visual relevance between the time increasing/decreasing key and the control mode selected by using the mode selection key and displayed on the mode display section is low, and visual relevance between the output increasing/decreasing key and the control mode selected by using the mode selection key and displayed on the mode display section is high. It can thus be easily recognized that the setting of the control mode other than the heating mode can be changed by the output increasing/decreasing key. Therefore, when the temperature adjustment mode is selected, a possibility that a user mistakenly operates the time increasing/decreasing key can be lowered and usability can be enhanced.

The operation unit may further include a heating start key. The control unit may start heating of the heating unit only when the heating start key is operated after any one of the plurality of control modes is selected by using the mode selection key. The cooking device may include a temperature adjustment mode which is a control mode for controlling the heating output of the heating unit so that the object to be heated is heated based on a predetermined set temperature; when the temperature adjustment mode is selected by using the mode selection key, the display unit may display, on the mode display section, that the temperature adjustment mode is selected, and after the heating is started according to the heating start key following the selection of the temperature adjustment mode, the display unit may display the set temperature in the temperature adjustment mode on the numerical value display section, to enable a change of the set temperature according to the output increasing/decreasing key. Therefore, the relevance between the time increasing/decreasing key and the display of the numerical value display section is made visually low in the control mode which is selected by using the mode selection key and is displayed on the mode display section. Accordingly, the user can more strongly recognize that the time increasing/decreasing key cannot be used in the selected control mode.

An ON/OFF key for starting heating and stopping heating may be arranged on the mode selection key side with respect to the output increasing/decreasing key. The time increasing/decreasing key is thus emphasized as being dedicated to time adjustment.

The cooking device may further include: a power switch, and a heating start key for starting heating. Only the mode selection key may be operable after the power is turned on; operation by operation keys other than the mode selection key may not be possible until any one of the control modes is selected by using the mode selection key; and operation of the heating start key may be a prerequisite for starting heating by the heating unit, after any one of the control modes is selected by using the mode selection key. The safety is enhanced since at least two operations are required until the start of heating after the power is turned on, and a conventional unlock key can be omitted, thereby decreasing the number of operation keys.

A symbol indicating the time increasing/decreasing key may be different from a symbol indicating the output increasing/decreasing key. The time increasing/decreasing key is thus emphasized as being dedicated to time adjustment.

According to the present invention, the numerical value display section is simplified by displaying, on the common numerical value display section, the set numerical values in the cooking mode in which time setting cannot be carried out, and the set time of timer. The time setting is facilitated by enabling the time setting of the setting timer to be increased and decreased. The selection of a plurality of cooking modes including a heating mode in which timer setting can be carried out and heating output can be set, and a cooking mode in which timer setting cannot be carried out, is made with one key, and a change of setting other than a change of the set time is carried out by using the output increasing/decreasing keys, so that the total number of keys is decreased and the key configuration is simplified. Furthermore, it is more easily recognized visually that the timer increasing/decreasing keys are dedicated to timer function. The usability in terms of key operation is thus satisfactory.

DETAILED DESCRIPTION OF THE INVENTION

An embodiment of the present invention will be described below with reference to the drawings. It should be noted that the present invention is not limited to the embodiment.

1. Configuration of Induction Cooking Device

Figure 1:
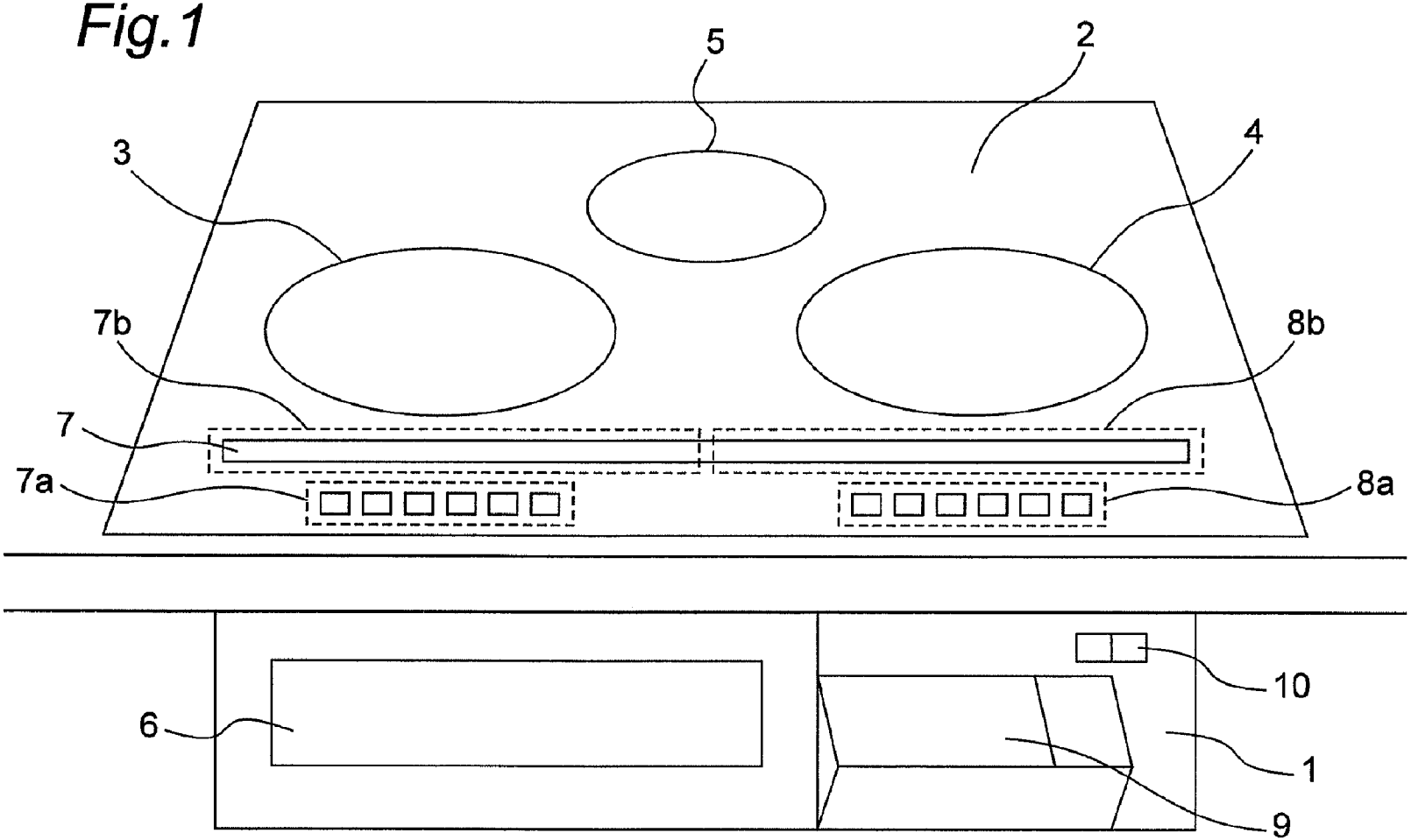
FIG. 1 is a perspective view of an induction cooking device according to an embodiment of the present invention.

A cooking device according to an embodiment of the present invention is an induction cooking device for induction heating an object to be heated. FIG. 1 is an overall perspective view of the induction cooking device according to the present embodiment, showing a state in which a built-in induction cooking device, which is one type of induction cooking device, is built in a kitchen counter. As shown in FIG. 1, the induction cooking device of the present embodiment includes a main body 1 configured as a shell, a top plate 2 provided on the upper surface of the main body 1 for mounting an object to be heated (see FIG. 2) such as a pan, a left induction heating unit indication 3 provided on the left front portion of the top plate 2, a right induction heating unit indication 4 arranged on the right front portion of the top plate 2, a back induction heating unit indication 5 arranged at the middle back portion of the top plate 2, a heating oven 6, a front surface operation unit 9 for performing input operations for the back induction heating unit 5 and the heating oven 6, and a power switch 10. A left upper surface operation section 7*a* and a right upper surface operation section 8*a* for performing input operations to operate the left induction heating unit 3 and the right induction heating unit 4 and a left upper surface display section 7*b* and a right upper surface display section 8*b* for displaying output settings and the like in heating within the left induction heating unit indication 3 and the right induction heating unit indication 4 are provided on the top plate 2 on the upper surface of the device.

Figure 2:
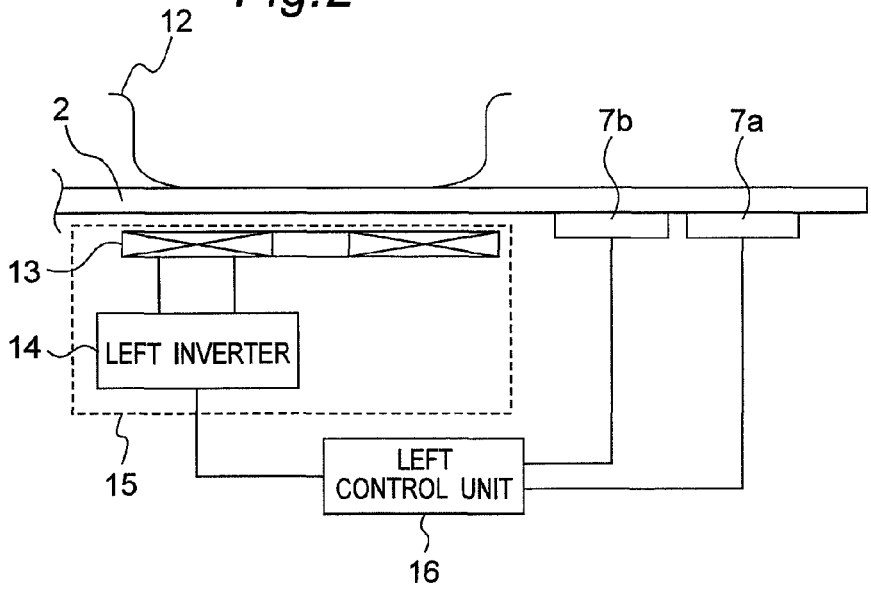
FIG. 2 is a schematic cross-sectional view of the induction cooking device.

FIG. 2 schematically shows a cross-sectional configuration of a left induction heating unit 15 corresponding to the left induction heating unit indication 3 of FIG. 1. A right induction heating unit (not shown) corresponding to the right induction heating unit indication 4 has a similar configuration, and thus the description thereof will not be given. A left heating coil 13 for induction heating an object to be heated 12 is arranged inside the cooking device such that the left heating coil 13 faces the left induction heating unit indication 3 below the top plate 2. The left induction heating unit 15 including a left inverter 14 for supplying a high frequency current to the left heating coil 13, and a left control unit 16 for controlling the output of the left inverter 14 are arranged inside the device. The left control unit 16 controls the heating output of the left induction heating unit 15 such that cooking is carried out at a control mode selected from a plurality of control modes. The plurality of control modes includes a heating mode for controlling the left induction heating unit 15 so that the object to be heated 12 is heated based on a predetermined set value for heating output. In the present embodiment, the temperature adjustment mode, the water boiling mode, and the rice cooking mode can be selected as the control mode other than the heating mode.

The left upper surface operation section 7*a* and the left upper surface display section 7*b* are arranged on the top plate 2 on the upper surface of the device. The left upper surface display section 7*b* is arranged between the left induction heating unit indication 3 on a far side and the left upper surface operation section 7*a* on a near side. The left control unit 16 includes a timer for counting time so that the object to be heated 12 is heated for a set time set by the left upper surface operation section 7*a* when any one of the plurality of control modes is selected (for example, when the heating mode is selected in the present embodiment).

Figure 3:
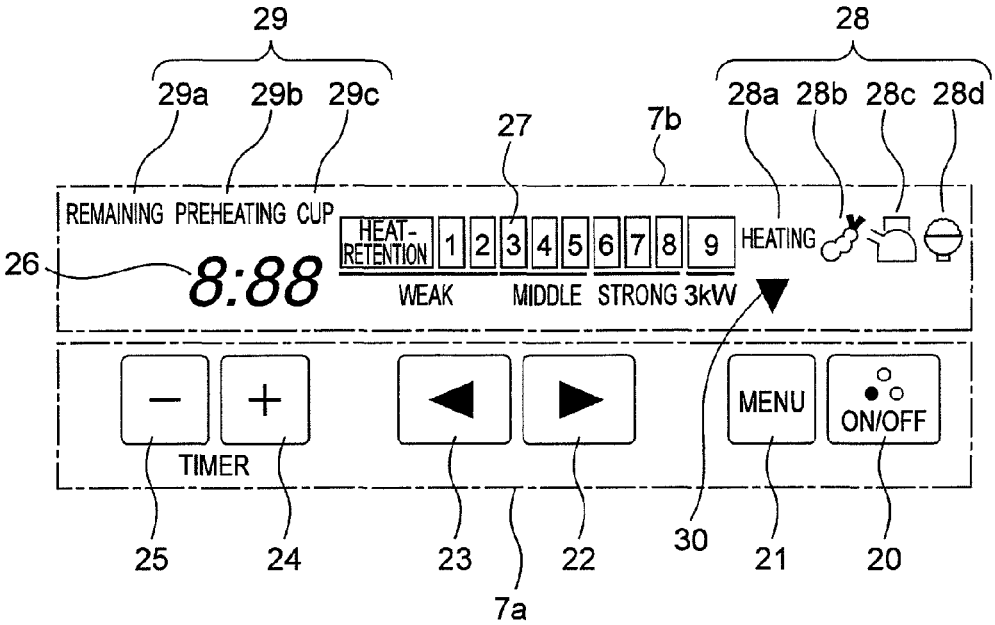
FIG. 3 is a plan view of main parts of the induction cooking device.

FIG. 3 shows the left upper surface operation section 7*a* and the left upper surface display section 7*b* corresponding to the left induction heating unit indication 3 of FIG. 1. The right upper surface operation section 8*a* and the right upper surface display section 8*b* corresponding to the right induction heating unit indication 4 of FIG. 1 have configurations similar to those shown in FIG. 3, and thus the description thereof will not be given. The left upper surface operation section 7*a* includes the following operation keys. In other words, a left mode selection key 21 (a character "menu" is printed and displayed on the relevant key) for selecting one of the plurality of control modes; a left heating ON/OFF key 20 for starting heating when heating is stopped and for stopping heating when heating is being carried out; a left output increasing key 22 capable of increasing the set value for heating output to be set in the heating mode and capable of increasing the set value for the temperature to be set in the temperature adjustment mode; a left output decreasing key 23 for decreasing the set value for heating output and the set value for the temperature (hereinafter, the left output increasing key 22 and the left output decreasing key 23 are sometimes collectively referred to as left output increasing/decreasing keys 22, 23); a left time increasing key 24 for increasing the time for heating according to the timer and a left time decreasing key 25 for decreasing the time for heating (hereinafter, the left time increasing key 24 and the left time decreasing key 25 are sometimes collectively referred to as left time increasing/decreasing keys 24, 25) are located within a region of the left upper surface operation section 7*a* shown by a dashed line in FIG. 3. A symbol of a triangular mark directed toward the right is given in the left output increasing key 22, and a symbol of a triangular mark directed toward the left is given in the left output decreasing key 23. Furthermore, a symbol of "+" is given in the left time increasing key 24 and a symbol of "–" is given in the left time decreasing key 25. Characters "timer" indicating as being the time increasing/decreasing keys is printed under the left time increasing/decreasing keys 24, 25.

An upper surface display unit 7 in black is provided on the top plate 2 shown in FIG. 1. The upper surface display unit 7 is a region that is formed by printing a thin film of a bright color, as if a portion of a band-shape is cut out, at a back surface of a light transmissive crystallized ceramic plate and forming a black thin-film layer at the cutout portion, to transmit light. A light-emitting element (not shown) such as an LED is provided under the upper surface display unit 7, so that each display section is illuminated and the characters and symbols can be clearly identified by light emitted from the LED corresponding to the necessary display section. The light-emitting element may be formed of an LCD or a fluorescent display tube. The printing color may be appropriately determined. The left upper surface display section 7*b* shown in FIG. 3 is arranged in the upper surface display unit 7, and includes a left numerical value display section 26 for displaying a numerical value of the set value in the selected control mode by arranging three display elements of seven segments; a left set content display section 29 positioned near the upper side of the left numerical value display section 26, for showing the content, the unit, or the like of the numerical values displayed on the left numerical value display section 26; a left output display section 27 for displaying the set value for heating output by arranging the segments for illuminating the characters of heat-retention and 1 to 9 in a bar shape in a horizontal direction; and a left mode display section 28 for displaying the cooking mode selected in order according to the left mode selection key 21.

A heating mode display 28*a* displayed with the characters "heating" and a remaining time display 29*a* displayed with the characters "remaining" are illuminated in the temperature adjustment mode; a left temperature adjustment mode display 28*b* displayed with a symbol indicating fried food and a preheating display 29*b* displayed with the characters "preheating" are illuminated in the temperature adjustment mode; a water boiling mode display 28*c* displayed with a symbol indicating a kettle is illuminated in the water boiling mode; and a rice cooking mode display 28*d* displayed with a symbol indicating rice and a bowl and a rice cooking amount (number of cups of rice) display 29*c* displayed with the characters "cup" are illuminated in the rice cooking mode. The left numerical value display section 26 is located near the upper side (far side) of the left time increasing/decreasing keys 24, 25. The left output display section 27 is located near the upper side (far side) of the left output increasing/decreasing keys 22, 23, the left mode selection key 21 is located on the opposite side of the left output increasing/decreasing keys 22, 23 from the left time increasing/decreasing keys 24, 25, and the left numerical value display section 26 is located on the opposite side of the left output display section 27 from the left mode display section 28.

2. Operation of Induction Cooking Device

The operation and the effects of the induction cooking device configured as above will now be described. When the power switch 10 is turned on, a left mode selection instruction indication 30 displayed with an inverted triangular mark (▼) is lighted up in the left upper surface display section 7*b* near the upper side of the left mode selection key, so that only the left mode selection key 21 can be operated for the left induction heating unit 15. While the left mode selection instruction indication 30 is illuminated, that is, unless any one of the control modes is selected by operating the left mode selection key 21, the operation according to any one of the operation keys cannot be performed. Furthermore, heating can be started only when the left heating ON/OFF key 20, which is the heating start key, is operated after any one of the control modes is selected by using the left mode selection key 21. Therefore, heating is prevented from being started carelessly, and safety is ensured.

When the left ON/OFF key 20 is operated (e.g., pushed) after selecting any one of the control modes by the left mode selection key 21, the left control unit 16 starts the ON/OFF control of the switching element (not shown) in the left inverter 14 to supply high frequency current to the heating coil 13, to thereby start induction heating of the object to be heated 12. The left ON/OFF key 20 is also used as a heating stop key for stopping heating when heating is being carried out by the left heating coil 13. The left ON/OFF key 20 is arranged on the same side as the left mode selection key 21 with respect to the left output increasing/decreasing keys 22, 23. The temperature adjustment mode can be selected by operating the mode selection key 21 to illuminate the left temperature adjustment mode display 28*b* in the left mode display section 28. If the left ON/OFF key 20, which is the heating start key, is operated while the temperature adjustment mode is selected, the left control unit 16 controls the heating output of the left induction heating unit 15 while detecting the temperature of the object to be heated 12 so that the temperature of the object to be heated 12 reaches a predetermined set temperature.

The left mode display section 28 displays that the temperature adjustment mode is selected by lighting the temperature adjustment mode display 28*b* when the temperature adjustment mode is selected by the left mode selection key 21, but the set temperature is not displayed on the left numerical value display section 26. After the left mode selection key 21 is operated to select the temperature adjustment mode, a numerical value of the set temperature is displayed on the left numerical value display section 26 after the heating is started through the operation of the left ON/OFF key 20. This enables the user to easily recognize that the left time increasing/decreasing keys 24, 25 cannot be operated in the temperature adjustment mode, thereby enhancing usability.

Therefore, the left mode selection key 21 and the left time increasing/decreasing keys 24, 25 are separated by the section of the left output increasing/decreasing keys 22, 23, and the left numerical value display section 26 and the left mode display section 28 are separated by the section of the left output display section 27 so that a distance between the left mode display section 28 and the left output increasing/decreasing keys 22, 23 becomes shorter than a distance between the left mode display section 28 and the left time increasing/decreasing keys 24, 25, whereby visual relevance between the left time increasing/decreasing keys 24, 25 and the control mode which is selected by the left mode selection key 21 and is displayed on the left mode display section 28 is low, and the visual relevance between the left output increasing/decreasing keys 22, 23 and the control mode which is selected by the left mode selection 21 and is displayed on the left mode display section 28 is high.

Therefore, it can be easily recognized that the setting of the control mode other than the heating mode can be changed by using the left output increasing/decreasing keys 22, 23. Therefore, the possibility that the user mistakenly operates the left time increasing/decreasing keys 24, 25 can be lowered when the temperature adjustment mode is selected, thereby enhancing usability.

The left heating start key 20 for starting heating is arranged after the control mode is selected by the left mode selection key 21, where the left control unit 16 can control the heating output of the left induction heating unit 14 in the temperature adjustment mode for controlling the heating output of the left induction heating unit 14 so that the temperature of the object to be heated 12 reaches a predetermined set temperature, the left mode selection key 21 allows the temperature adjustment mode to be selectable, the left mode display section 28 displays that the temperature adjustment mode is selected when the temperature adjustment mode is selected, and the left numerical value display section 26 displays a numerical value of the set temperature in the temperature adjustment mode after the heating is started by the left heating start key 20 following the selection of the temperature adjustment mode, so that the visual relevance between the left time increasing/decreasing keys 24, 25 and the control mode which is selected by the left mode selection key 21 and is displayed on the left mode display section 28 is low, and the visual relevance between the left output increasing/decreasing keys 22, 23 and the control mode which is selected by the left mode selection key 21 and is displayed on the left mode display section 28 is high.

The left time increasing/decreasing keys 24, 25 are emphasized as being dedicated to time adjustment by arranging the left ON/OFF key 20 for starting heating and stopping heating on the same side as the left mode selection key 21 with respect to the left output increasing/decreasing keys 22, 23.

After the power switch 10 is turned on, only the left mode selection key 21 can be operated for the left induction heating unit 15, where operation by any of the operation keys cannot be carried out unless one of the control modes is selected by the left mode selection key 21, and heating is started only when the left heating ON/OFF key 20 or the heating start key is operated after one of the control modes is selected by using the left mode selection key, whereby safety is enhanced since at least two operations are required until the start of heating after the power switch 10 is turned on, and a conventional unlock key can be omitted, thereby decreasing the number of operation keys.

The time increasing/decreasing keys can be emphasized as being dedicated to time adjustment by making the symbol indicating the time increasing/decreasing keys and the symbol indicating the output increasing/decreasing keys different.

The left time increasing/decreasing keys 24, 25 are dedicated to time adjustment in the embodiment described above, but the temperature may be adjusted by using the left time increasing/decreasing keys 24, 25 in addition to the left output increasing/decreasing keys 22, 23 in the temperature adjustment mode. Such a configuration is convenient since the user can change the temperature setting even when the user mistakenly operates the left time increasing/decreasing keys 24, 25 while the left numerical value display section 26 is illuminated.

The left numerical value display section 26 is not illuminated when the operation of selecting the temperature adjustment mode by using the left mode selection key 21 is merely performed in the above-described embodiment, but the left numerical value display section 26 may be illuminated when the operation of selecting temperature adjustment mode by using the left mode selection key 21 is merely performed, and the temperature may be adjusted by using the left time increasing/decreasing keys 24, 25 in addition to the left output increasing/decreasing keys 22, 23. Such a configuration is convenient since the set temperature is displayed on the left numerical value display section 26 before starting heating according to the left heating ON/OFF key 20, and the temperature can be adjusted by using the left time increasing/decreasing keys 24, 25 in the vicinity of the left numerical value display section 26.

In the present embodiment, the operable key is shown by the left mode selection instruction indication 30 displayed with an inverted triangular mark (▼) after the power switch 10 is turned on. However, instead of arranging the left mode selection instruction indication 30, only the operable left mode selection key 21 may be illuminated and displayed and other keys may be non-illuminated so as not to be visible.

In the above-described embodiment, the cooking device of the induction heating type has been described by way of example, but the present invention is also applicable to a gas cooker including a top plate.

A cooking device according to the present invention can improve usability related to a key operation, and thus can be applied not only to a built-in induction cooking device including an operation switch provided on an upper surface of the device, but also to a mounting type or tabletop type induction cooking device other than the built-in type, and further to a cooking device including one or more induction heating units. The present invention is also applicable to a cooking device of an electric heater heating type, a halogen lamp heating type, and a gas heating type including a glass plate.

The invention claimed is:

1. A cooking device comprising:

a top plate provided on an upper surface of the cooking device;

a heating unit operable to heat an object to be heated;

a control unit operable to control a heating output of the heating unit for cooking according to a control mode selected from a plurality of control modes, the plurality of control modes including a heating mode for controlling the heating unit to heat the object to be heated based on a predetermined set value for heating output;

an operation unit provided on an upper surface of the cooking device;

a display unit provided on the upper surface of the cooking device; and a timer operable to count time to heat for a predetermined set time in one of the plurality of control modes;

wherein the operation unit includes a mode selection key for selecting one of the plurality of control modes, an output increasing/decreasing key for increasing or decreasing a set output and a set temperature, and a time increasing/decreasing key for increasing or decreasing time for heating according to the timer;

wherein the display unit includes a numerical value display section for displaying a numerical value of a set value in the selected control mode, an output display section for displaying the set value for heating output, and a mode display section for displaying the cooking mode selected by using the mode selection key;

wherein the numerical value display section is located near the time increasing/decreasing key, the output display section is located near the output increasing/decreasing key, the mode selection key is located on the opposite side of the output increasing/decreasing key from the time increasing/decreasing key, and the numerical value display section is located on the opposite side of the output display section from the mode display section;

wherein the operation unit further includes a heating start key;

wherein the control unit starts heating of the heating unit only when the heating start key is operated after any one of the plurality of control modes is selected by using the mode selection key;

wherein the control unit includes a temperature adjustment mode which is a control mode for controlling the heating output of the heating unit so that a temperature of the object to be heated reaches a predetermined set temperature;

wherein when the temperature adjustment mode is selected by using the mode selection key, the display unit displays, on the mode display section, that the temperature adjustment mode is selected; and wherein after the heating is started according to the heating start key following the selection of the temperature adjustment mode, the display unit displays the set temperature in the temperature adjustment mode on the numerical value display section, to enable a change of the set temperature according to the output increasing/decreasing key.

2. The cooking device according to claim 1, wherein the heating start key is constituted by an ON/OFF key for starting heating and stopping heating, said ON/OFF key being arranged on the mode selection key side with respect to the output increasing/decreasing key.

3. The cooking device according to claim 2, wherein a symbol indicating the time increasing/decreasing key is different from a symbol indicating the output increasing/decreasing key.

4. The cooking device according to claim 1, further comprising a power switch, and wherein only the mode selection key is operable after the power is turned on;

operation by operation keys other than the mode selection key is not possible until any one of the control modes is selected by using the mode selection key; and operation of the heating start key is a prerequisite for starting heating by the heating unit, after any one of the control modes is selected by the mode selection key.

5. The cooking device according to claim 4, wherein a symbol indicating the time increasing/decreasing key is different from a symbol indicating the output increasing/decreasing key.

6. The cooking device according to claim 1, wherein a symbol indicating the time increasing/decreasing key is different from a symbol indicating the output increasing/decreasing key.

7. A cooking device comprising:

a top plate provided on an upper surface of the cooking device;

a heating unit operable to heat an object to be heated;

a control unit operable to control a heating output of the heating unit for cooking according to a control mode selected from a plurality of control modes, the plurality of control modes including a heating mode for controlling the heating unit to heat the object to be heated based on a predetermined set value for heating output;

an operation unit provided on an upper surface of the cooking device;

a display unit provided on the upper surface of the cooking device; and a timer operable to count time to heat for a predetermined set time in one of the plurality of control modes;

wherein the operation unit includes a mode selection key for selecting one of the plurality of control modes, an output increasing/decreasing key for increasing or decreasing a set output and a set temperature, and a time increasing/decreasing key for increasing or decreasing time for heating according to the timer;

wherein the display unit includes a numerical value display section for displaying a numerical value of a set value in the selected control mode, an output display section for displaying the set value for heating output, and a mode display section for displaying the cooking mode selected by using the mode selection key;

wherein the numerical value display section is located near the time increasing/decreasing key, the output display section is located near the output increasing/decreasing key, the mode selection key is located on the opposite side of the output increasing/decreasing key from the time increasing/decreasing key, and the numerical value display section is located on the opposite side of the output display section from the mode display section;

wherein an ON/OFF key for starting heating and stopping heating is arranged on the mode selection key side with respect to the output increasing/decreasing key.

8. The cooking device according to claim 7, wherein the control unit starts heating of the heating unit only when the ON/OFF key is operated after any one of the plurality of control modes is selected by using the mode selection key;

the control unit includes a temperature adjustment mode which is a control mode for controlling the heating output of the heating unit so that a temperature of the object to be heated reaches a predetermined set temperature;

when the temperature adjustment mode is selected by using the mode selection key, the display unit displays, on the mode display section, that the temperature adjustment mode is selected, and after the heating is started according to the ON/OFF key following the selection of the temperature adjustment mode, the display unit displays the set temperature in the temperature adjustment mode on the numerical value display section, to enable a change of the set temperature according to the output increasing/decreasing key.

9. The cooking device according to claim 8, wherein a symbol indicating the time increasing/decreasing key is different from a symbol indicating the output increasing/decreasing key.

10. The cooking device according to claim 7, further comprising a power switch, and wherein only the mode selection key is operable after the power is turned on;

operation by operation keys other than the mode selection key is not possible until any one of the control modes is selected by using the mode selection key; and operation of the heating start key is a prerequisite for starting heating by the heating unit, after any one of the control modes is selected by the mode selection key.

11. The cooking device according to claim 10, wherein a symbol indicating the time increasing/decreasing key is different from a symbol indicating the output increasing/decreasing key.

12. The cooking device according to claim 7, wherein a symbol indicating the time increasing/decreasing key is different from a symbol indicating the output increasing/decreasing key.

13. A cooking device comprising:

a top plate provided on an upper surface of the cooking device;

a heating unit operable to heat an object to be heated;

a control unit operable to control a heating output of the heating unit for cooking according to a control mode selected from a plurality of control modes, the plurality of control modes including a heating mode for controlling the heating unit to heat the object to be heated based on a predetermined set value for heating output;

an operation unit provided on an upper surface of the cooking device;

a display unit provided on the upper surface of the cooking device;

a timer operable to count time to heat for a predetermined set time in one of the plurality of control modes; and a power switch, and a heating start key for starting heating;

wherein the operation unit includes a mode selection key for selecting one of the plurality of control modes, an output increasing/decreasing key for increasing or decreasing a set output and a set temperature, and a time increasing/decreasing key for increasing or decreasing time for heating according to the timer;

wherein the display unit includes a numerical value display section for displaying a numerical value of a set value in the selected control mode, an output display section for displaying the set value for heating output, and a mode display section for displaying the cooking mode selected by using the mode selection key;

wherein the numerical value display section is located near the time increasing/decreasing key, the output display section is located near the output increasing/decreasing key, the mode selection key is located on the opposite side of the output increasing/decreasing key from the time increasing/decreasing key, and the numerical value display section is located on the opposite side of the output display section from the mode display section;

wherein only the mode selection key is operable after the power is turned on;

wherein operation by operation keys other than the mode selection key is not possible until any one of the control modes is selected by using the mode selection key; and wherein operation of the heating start key is a prerequisite for starting heating by the heating unit, after any one of the control modes is selected by the mode selection key.

14. The cooking device according to claim 13, wherein the control unit starts heating of the heating unit only when the heating start key is operated after any one of the plurality of control modes is selected by using the mode selection key;

the control unit includes a temperature adjustment mode which is a control mode for controlling the heating output of the heating unit so that a temperature of the object to be heated reaches a predetermined set temperature;

when the temperature adjustment mode is selected by using the mode selection key, the display unit displays, on the mode display section, that the temperature adjustment mode is selected, and after the heating is started according to the heating start key following the selection of the temperature adjustment mode, the display unit displays the set temperature in the temperature adjustment mode on the numerical value display section, to enable a change of the set temperature according to the output increasing/decreasing key.

15. The cooking device according to claim 14, wherein a symbol indicating the time increasing/decreasing key is different from a symbol indicating the output increasing/decreasing key.

16. The cooking device according to claim 13, wherein the heating start key is constituted by an ON/OFF key for starting heating and stopping heating, the ON/OFF key being arranged on the mode selection key side with respect to the output increasing/decreasing key.

17. The cooking device according to claim 16, wherein a symbol indicating the time increasing/decreasing key is different from a symbol indicating the output increasing/decreasing key.

18. The cooking device according to claim 13, wherein a symbol indicating the time increasing/decreasing key is different from a symbol indicating the output increasing/decreasing key.

* * * * *